US007281911B2

(12) United States Patent
Kim

(10) Patent No.: US 7,281,911 B2
(45) Date of Patent: Oct. 16, 2007

(54) LINEAR COMPRESSOR

(75) Inventor: Jeong Woo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/191,906

(22) Filed: Jul. 29, 2005

(65) Prior Publication Data

US 2006/0060197 A1 Mar. 23, 2006

(30) Foreign Application Priority Data

Sep. 20, 2004 (KR) ..... 10-2004-0075032

(51) Int. Cl.
*F04B 39/10* (2006.01)
*F04B 53/10* (2006.01)

(52) U.S. Cl. ..... 417/569; 417/570; 417/902

(58) Field of Classification Search ..... 417/417, 417/540, 551, 569, 570, 902; 137/543.17
See application file for complete search history.

(56) References Cited

U.S. PATENT DOCUMENTS 6,824,365 B2 * 11/2004 Park et al. ..... 417/312
6,914,353 B2 * 7/2005 Hong et al. ..... 310/13
2004/0245862 A1 12/2004 Hong et al.
2004/0245863 A1 * 12/2004 Hong et al. ..... 310/14
2004/0247457 A1 12/2004 Kim et al.
2005/0142014 A1 * 6/2005 Jung et al. ..... 417/540

OTHER PUBLICATIONS

U.S. Appl. No. 11/165,189 to Jung et al., which was filed on Jun. 24, 2005.

* cited by examiner

*Primary Examiner*—Patricia Bianco
*Assistant Examiner*—Nihir Patel
(74) *Attorney, Agent, or Firm*—Greenblum & Bernstein, P.L.C.

(57) ABSTRACT

Disclosed herein is a linear compressor. In the present invention, an edge of a loop pipe, which is inserted into an outer exhale cover is inclined. It takes effect in enhancing reliability of the product and its assembling capacity, not to clog the edge of the loop pipe by an inner exhale cover.

20 Claims, 4 Drawing Sheets

LINEAR COMPRESSOR

BACKGROUND OF THE INVENTION

1. Field of the Invention

The present invention relates to a linear compressor, more particularly, wherein an edge of a loop pipe, which is inserted into an outer exhale cover in order to discharge fluid in the outer exhale cover to the outside is inclined. The linear compressor is capable of preventing the edge of the loop pipe from clogging by an inner exhale cover, and of improving an assembling capacity and reliability.

2. Description of the Related Art

Generally, a linear compressor is a machine to inhale, to compress, and to discharge fluid by linearly reciprocating a piston within a cylinder, by means of linear driving force of a linear motor.

FIG. 1 shows the linear compressor, based on the prior art, and FIG. 2 shows a structure of an exhale part of the linear compressor, based on the prior art.

In a hermetic casing 2 of the linear compressor, according to the prior art comprises a cylinder block 4 having the cylinder 3, and a back cover 6 having an inlet 5 are equipped. The cylinder block 4 and the back cover 6 are upheld in the hermetic casing 2 by a main damper 7 and a subsidiary damper 8, so as to absorb a shock(see FIG. 1).

The linear motor 10 is disposed between the cylinder block 4 and the back cover 6, which generates driving force to compress fluid.

The linear motor 10 is divided by a stationary part and a movable part. The stationary part includes an outer core 11, an inner core 12, and a coil 13 with a magnetic field. The movable part includes a magnet 14 that linearly reciprocates by magnetic force around the coil 13, and a magnet frame 15 which the magnet 14 is fastened to.

The piston 16 is mounted in the cylinder 3, which receives linear driving force from the magnet 14, linearly reciprocates, and compresses fluid within the cylinder 3.

In a rear of the piston 16, a flange 17 is formed to be fixed to the magnet frame 15. A main spring 18 is disposed between the flange 17 and the cylinder block 4, and a subsidiary spring 19 is disposed between the flange 17 and the back cover 6, so that the piston 16 is elastically suspended.

The piston 16 is in a shape of a cylinder, which is open at its rear. An inhale passage 20 where fluid is entered is provided therein, and a plurality of inhale ports 21 is provided in its front.

In a front of the piston 16, there is an inhale valve 22 for opening and closing the inhale port 21. Fastened to the piston 16 by a connection member, the inhale valve 22 gets elastically bended, depending on a pressure difference between the inside and the outside of the inhale port 21, thus opening and closing the inhale port 21.

The exhale part 30 is formed in a front of a compression chamber C of the cylinder 3, where compressed fluid is discharged.

The exhale part 30 includes an inner exhale cover 32 fixed to the cylinder block 4 and provided with an exhale hole 31, an exhale valve 34 suspended to the inner exhale cover 32 by an exhale spring 33, so as to open and close the compression chamber C of the cylinder 3, and an outer exhale cover 35 positioned at a regular interval from an outer surface of the inner exhale cover 32 (see FIG. 2).

The outer exhale cover 35 has a connection pipe 37 combined with a loop pipe 36 which discharges compressed fluid to the outside.

One end of the loop pipe 36 is connected to the connection pipe 37, and the other end penetrates the hermetic casing 2. To reduce a vibration and a noise occurred by discharging compressed fluid, a material is equipped at a predetermined position of the loop pipe. Otherwise, the loop pipe functions as the material by being rolled several times at a predetermined position or by being bended.

When assembling the loop pipe 36, one end of the loop pipe 36 is inserted into the connection pipe 37, and is fixed by welding.

The linear compressor having the conventional structure of the exhale part operates in the following sequence.

In operation of the linear motor 10, the piston 16 has linearly reciprocating motion within the cylinder 3. The inhale valve 22 is opened and closed, depending on the pressure difference between the inhale passage 20 of the piston 16 and the compression chamber C.

When the pressure of the inhale passage 20 of the piston 16 is higher than that of the compression chamber C, the inhale valve 22 becomes opened, while elastically bended toward the compression chamber C. Fluid in the inhale passage 20 of the piston 16 is flowed into the compression chamber C through the inhale port 21.

On the contrary, when the pressure of the compression chamber C is higher than that of the inhale passage 20 of the piston 16, the inhale valve becomes closed. Fluid in the compression chamber C is compressed by the piston 16, makes the exhale valve 34 open, and then is discharged through the inner exhale cover 32 and the outer exhale cover 35.

However, in the conventional exhale part of the linear compressor, when the loop pipe 36 is inserted into the outer exhale cover 35, it has difficulty in assembling an edge 38 of the loop pipe 36, while spaced apart from the inner exhale cover 32.

Furthermore, if the loop pipe 36 is excessively inserted, the edge 38 of the loop pipe 36 may face the inner exhale cover 32. In this case, the edge 38 of the loop pipe 36 becomes clogged, and compressed fluid cannot be discharged through the loop pipe 36 to the outside.

SUMMARY OF THE INVENTION

Accordingly, it is an aspect of the present invention to provide a linear compressor having an inclined edge of a loop pipe, which prevents the loop pipe from clogging, and improves operation efficiency and reliability of the product.

The foregoing and other aspects are achieved by providing the linear compressor based on the present invention, which comprises an exhale valve which opens and closes a cylinder, an inner exhale cover provided with an exhale hole which discharges fluid drained from the cylinder, an outer exhale cover positioned at a regular interval from an outer surface of the inner exhale cover, and the loop pipe inserted into the outer exhale cover to discharge fluid in the outer exhale cover to the outside. The edge of the loop pipe, which is inserted into the outer exhale cover is inclined.

The outer exhale cover is equipped with a connection pipe to be connected to the loop pipe.

The connection pipe is perpendicular to a direction of a piston in the outer exhale cover.

The loop pipe is combined with the connection pipe by welding.

The loop pipe is rolled several times at a predetermined position within a hermetic casing.

The inner exhale cover is provided with an exhale spring for elastically holding the exhale valve.

The linear compressor, in accordance with the present invention comprises the hermetic casing, a linear motor equipped in the hermetic casing, a cylinder block set in the linear motor and provided with the cylinder, the piston which linearly reciprocates by the linear motor in the cylinder, and an exhale part located in a front of an opening of the cylinder to discharge fluid compressed in the cylinder. The exhale part includes the exhale valve that opens and closes the cylinder, the inner exhale cover having the exhale valve and the exhale hole that discharges fluid drained from the cylinder, the outer exhale cover placed at a regular interval from the outer surface of the inner exhale cover, and the loop pipe having the inclined edge inserted into the outer exhale cover to discharge fluid in the outer exhale cover to the outside.

The outer exhale cover is equipped with the connection pipe to be connected to the loop pipe.

The connection pipe is perpendicular to the direction of the piston in the outer exhale cover.

The loop pipe is combined with the connection pipe by welding.

In the present invention providing the linear compressor having the above-mentioned construction, as the edge of the loop pipe, which is inserted into the outer exhale cover is inclined, it can prevent the edge of the loop pipe from clogging by the inner exhale cover, and it can improve reliability of the product and its assembling capacity.

BRIEF DESCRIPTION OF THE DRAWINGS

These and other objects and advantages of the present invention will become apparent and more readily appreciated from the following description of the embodiments of the invention, taken in conjunction with the accompanying drawings of which.

DETAILED DESCRIPTION OF THE PREFERRED EMBODIMENT

Figure 1:
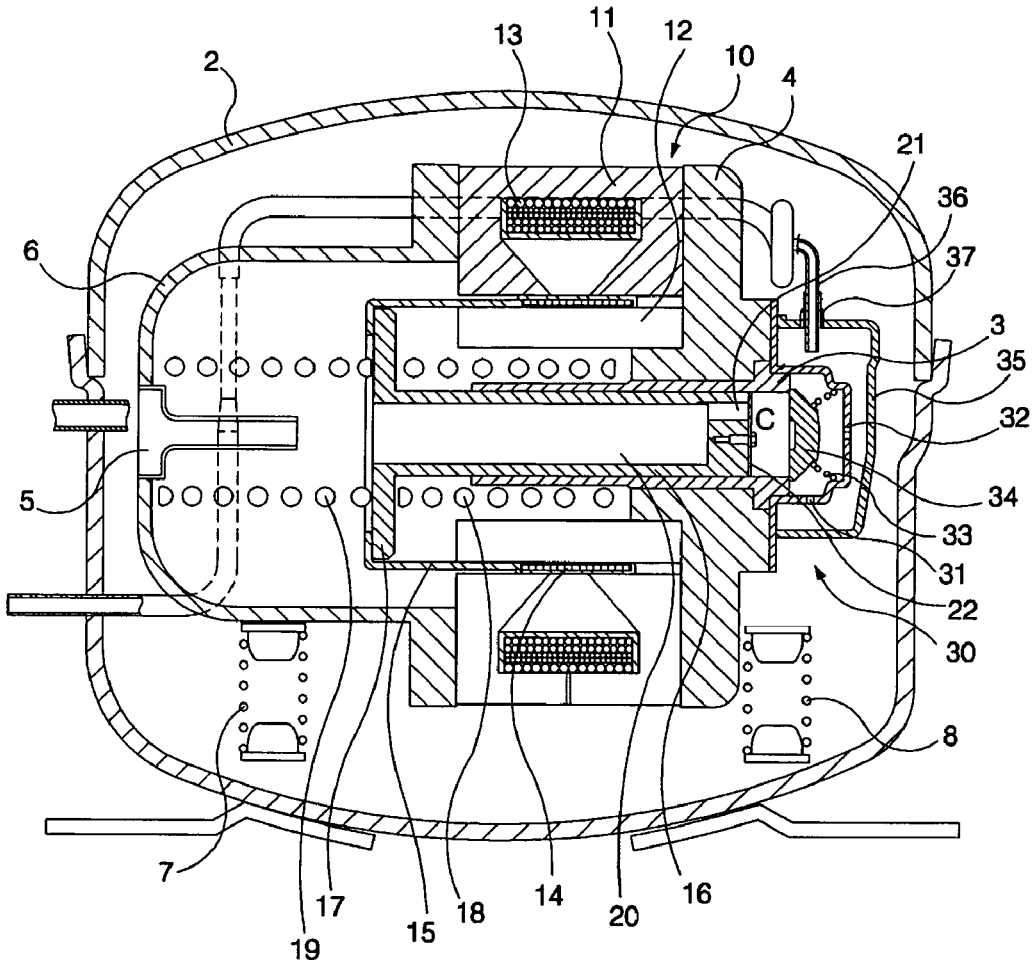
FIG. 1 (Prior Art)
FIG. 1 is a vertically sectional view of a linear compressor, according to the prior art.
Figure 2:
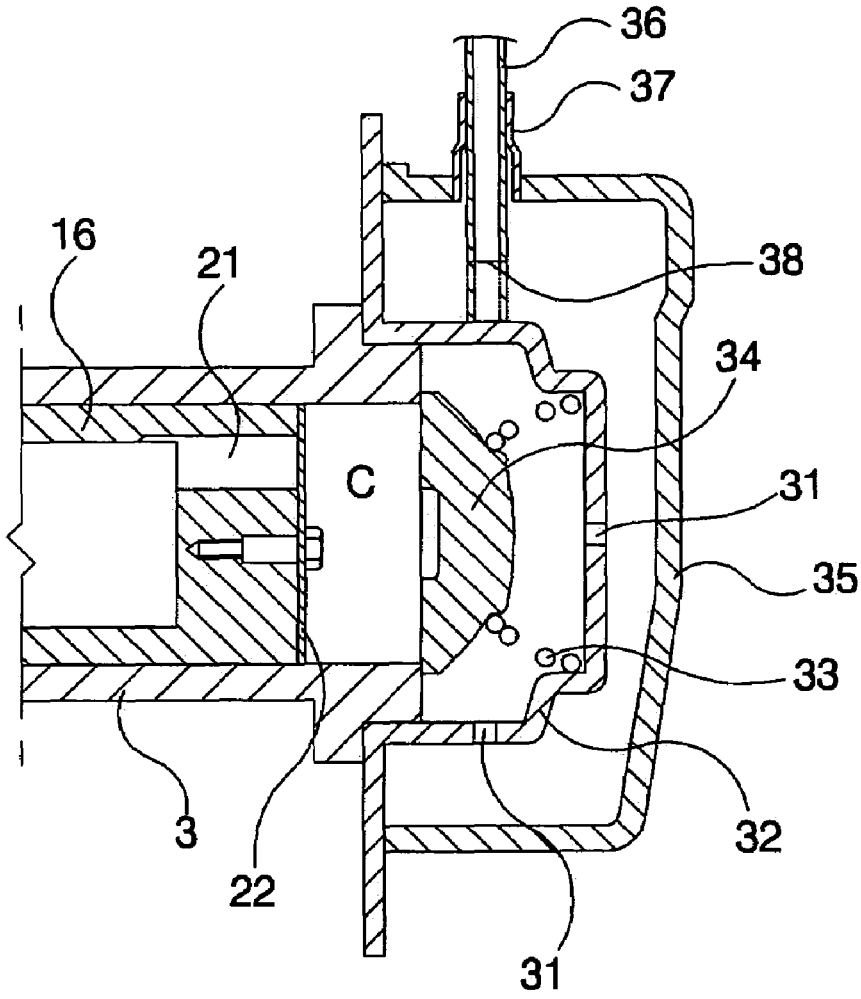
FIG. 2 (Prior Art)
FIG. 2 is a sectional view of a structure of an exhale part of the linear compressor, according to the prior art.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
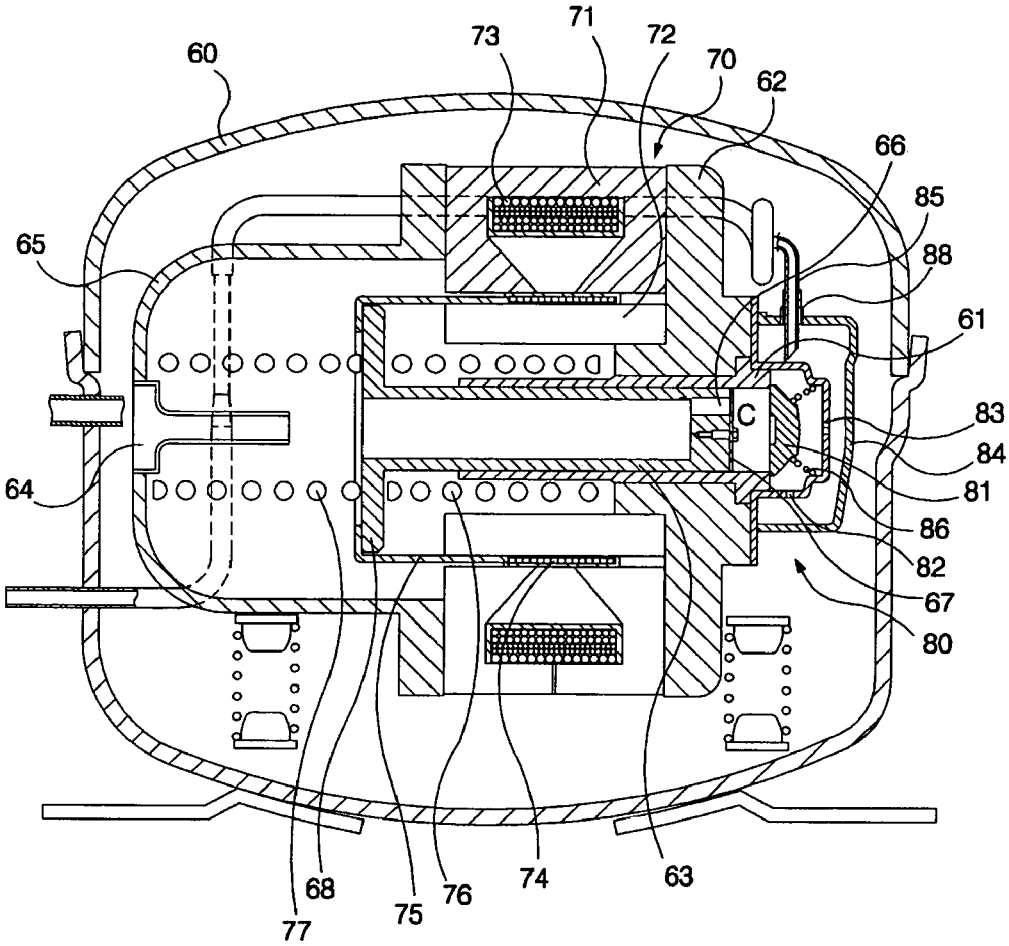
FIG. 3 is a vertically sectional view of the linear compressor, according to the present invention.
Figure 4:
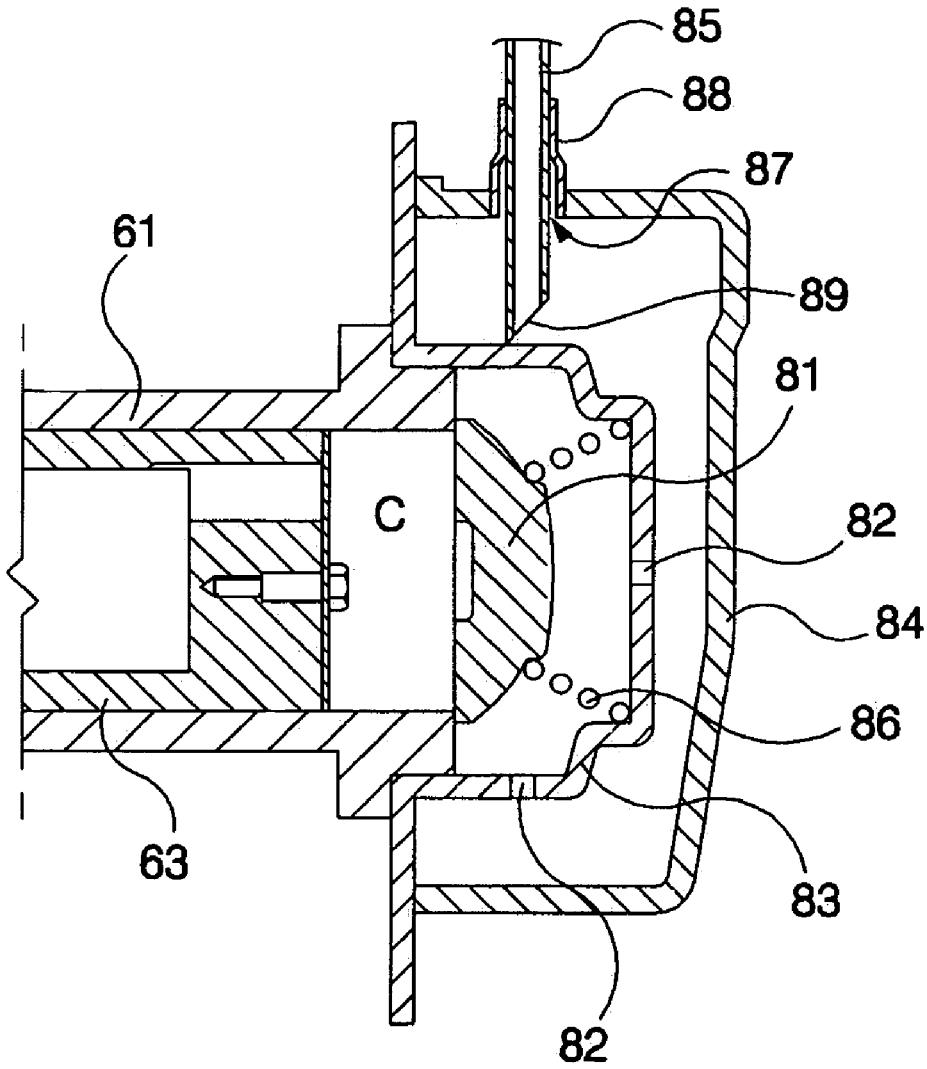
FIG. 4 is a sectional view of the structure of the exhale part of the linear compressor, according to the present invention.

FIG. 3 shows a linear compressor, according to the present invention, and FIG. 4 shows a structure of an exhale (or discharge) part of the linear compressor, according to the present invention.

As referring to FIGS. 3 to 4, the linear compressor, in accordance with the present invention comprises a hermetic casing 60, a linear motor 70 installed in the hermetic casing 60, a cylinder block 62 set in the linear motor 70 and provided with a cylinder 61, a piston 63 set in the cylinder 61 to reciprocally move back and forth, by means of the linear motor 70, and the exhale part 80 positioned in a front of an opening of the cylinder 61 to discharge fluid compressed in the cylinder 61.

The cylinder block 62 is mounted in a front of the linear motor 70, while a back cover 65 having an inlet 64 is mounted in a rear of the linear motor 70.

The linear motor 70 is divided by a stationary part and a movable part. The stationary part includes an outer core 71, an inner core 72, and a coil 73 with a magnetic field. The movable part includes a magnet 74 that linearly reciprocate by magnetic force around the coil 73, and a magnetic frame 75 where the magnet 74 is fastened.

In one end of the cylinder 61, the piston 63 is inserted, and the other end is a cylindrical shape which is open at both sides, so as to discharge compressed fluid. The piston 63 and the exhale part 80 make a compression chamber C.

The piston 63 is in a shape of a cylinder. In a front, an inlet 66 for inhaling fluid is placed, and an inhale valve 67 for opening and closing the inlet 66 is fixed by a connection member like a bolt.

The piston 63 has a flange 68 in its rear, so as to be combined with the magnetic frame 75. As a main spring 76 is disposed between the flange 68 and the cylinder block 62, and a subsidiary spring 77 is disposed between the flange 68 and the back cover 65, so that the piston 63 is elastically supported.

The exhale part 80 includes an exhale valve 81 which opens and closes the opening of the cylinder 61, an inner exhale (or discharge) cover 83 provided with the exhale valve 81, an outer exhale (or discharge) cover 84 positioned at a regular interval from an outer surface of the inner exhale cover 83, and a loop pipe 85 inserted into the outer exhale cover 84 to discharge fluid in the outer exhale cover 84 to the outside.

The exhale valve 81 is elastically held in the inner exhale cover 83 by an exhale spring 86. The exhale spring 86 is a conic coil spring to give the elasticity toward a direction that the exhale valve 81 closes the compression chamber C of the cylinder 61.

An exhale hole 82 is located in the inner exhale cover 83, so that fluid drained from the compression chamber C is discharged to the outer exhale cover 84.

The exhale hole 82 is respectively formed in a front of the inner exhale cover 84 and its circumference.

The outer exhale cover 84 has a predetermined interval from the inner exhale cover 83, apart from the outer surface of the inner exhale cover 83.

An outlet 87 is perpendicular to a direction of the piston 63 in the outer exhale cover 84, so as to discharge compressed fluid to the outside of the outer exhale cover 84. The outlet 87 has a connection pipe 88 to be connected to the loop pipe 85.

The loop pipe 85 is inserted into a space between the outer exhale cover 84 and the inner exhale cover 83 through the connection pipe 88. In case that the loop pipe 85 is excessively inserted into the space between the outer exhale cover 84 and the inner exhale cover 83, at least one end of an edge of the loop pipe 85 is distant from the inner exhale cover 83 by predetermined distance.

The loop pipe 85 has the inclined edge 89 inserted into the outer exhale cover 84.

The loop pipe 85 is fixed by welding after being inserted into the connection pipe 88.

The case that the loop pipe 85 functions as a material by being rolled several times at a predetermined position or by being bended, in order to reduce a vibration and a noise occurring from discharging compressed fluid is explained as an example in the present invention, the loop pipe may have the material at a predetermined position.

A process of the linear compressor having the exhale part, according to the present invention is described in the following.

When the linear motor 70 is in operation, the piston 63 linearly reciprocates within the cylinder 61.

When the piston 63 moves forward, the exhale valve 81 becomes opened by the pressure of fluid compressed in the cylinder 61. Compressed fluid is discharged to the inside of the inner exhale cover 83.

Fluid discharged to the inner exhale cover 83 is discharged to the outer exhale cover 84 through the exhale hole 82 in the inner exhale cover 83.

Fluid discharged to the space between the inner exhale cover 83 and the outer exhale cover 84 is discharged to the outside through the loop pipe 85 connected to the outer exhale cover 84.

As the edge of the loop pipe 85 is arranged between the inner exhale cover 83 and the outer exhale cover 84, compressed fluid can be discharged to the outside through the loop pipe 85.

Even though the loop pipe 85 is excessively inserted into the outer exhale cover 84 through the connection pipe 88, in assembling the loop pipe 85, as the edge 89 of the loop pipe 85 is inclined, only one end of the edge 89 of the loop pipe 85 is touched with the inner exhale cover 83, thus preventing the edge 89 of the loop pipe 85 from clogging.

As a result, fluid discharged to the outer exhale cover 84 from the exhale hole 82 of the inner exhale cover 83 can be smoothly discharged to the outside after flowing into the edge 89 of the loop pipe 85.

The operational effects of the linear compressor, according to the present invention are described in the following.

As apparent from the above description, the linear compressor of the present invention provides the inclined edge of the loop pipe, which is inserted into the outer exhale cover. The edge of the loop pipe is not clogged by the inner exhale cover. Thus, reliability of the product and its assembling capacity can be improved.

Although a few embodiments of the present invention have been shown and described, it would be appreciated by those skilled in the art that changes may be made in this embodiment without departing from the principles and spirit of the invention, the scope of which is defined in the claims and their equivalents.

The present disclosure relates to subject matter contained in Korean Application No. 10-2004-0075032, filed on Sep. 20, 2004, the contents of which are herein expressly incorporated by reference in its entirety.

What is claimed is:

1. A linear compressor comprising:

an inner discharge cover which elastically supports a discharge valve to open and close a cylinder, said inner discharge cover having an opening to discharge fluid drained from the cylinder;

an outer discharge cover spaced from an outer surface of the inner discharge cover; and a loop pipe that extends into the outer discharge cover to discharge fluid within the outer discharge cover to an exterior of the compressor, wherein an end of the loop pipe that extends into the outer discharge cover is configured such that, when at least a portion of an edge of the end of the loop pipe is in contact with an outer surface of the inner discharge cover at which the opening is not positioned, another portion of the edge of the end of the loop pipe is spaced from the outer surface of the inner discharge cover.

2. A linear compressor comprising:

an inner discharge cover which elastically supports a discharge valve to open and close a cylinder, said inner discharge cover having an opening to discharge fluid drained from the cylinder;

an outer discharge cover spaced from an outer surface of the inner discharge cover; and a loop pipe that extends into the outer discharge cover to discharge fluid within the outer discharge cover to an exterior of the compressor, wherein an end of the loop pipe that extends into the outer discharge cover is configured such that, when at least a portion of an edge of the end of the loop pipe is in contact with the inner discharge cover, another portion of the edge of the end of the loop pipe is spaced from the inner discharge cover, and wherein the end of the loop pipe that extends into the outer discharge cover is slanted with respect to the outer surface of the inner discharge cover.

3. The linear compressor as set forth in claim 2, wherein a connection pipe is provided in the outer discharge cover, so as to be connected to the loop pipe.

4. The linear compressor as set forth in claim 3, wherein an outlet is provided in the outer discharge cover and extends perpendicularly to a direction of movement of a piston in the cylinder.

5. The linear compressor as set forth in claim 4, wherein the connection pipe is provided in the outlet.

6. The linear compressor as set forth in claim 3, wherein a connection between the loop pipe and the connection pipe comprises a weld.

7. The linear compressor as set forth in claim 6, wherein the linear compressor further comprises a hermetic casing and the loop pipe is configured to define at least one loop within the hermetic casing.

8. The linear compressor as set forth in claim 7, wherein the inner discharge cover has a discharge spring to elastically support the discharge valve.

9. The linear compressor as set forth in claim 8, wherein the discharge spring is a conic coil spring configured to apply an elastic biasing force in a direction such that the discharge valve closes an opening of the cylinder.

10. The linear compressor as set forth in claim 6, wherein the linear compressor further comprises a hermetic casing and the loop pipe comprises a vibration reducing and noise preventing material within the hermetic casing.

11. A linear compressor comprising:

a hermetic casing;

a linear motor provided in the hermetic casing;

a cylinder block in the linear motor and provided with a cylinder;

a piston which is linearly reciprocated in the cylinder by the linear motor; and a discharge element positioned in the front of an opening of the cylinder to discharge fluid compressed in the cylinder, wherein the discharge element includes:

a discharge valve which opens and closes the cylinder;

an inner discharge cover which elastically supports the discharge valve and has an opening to discharge fluid drained from the cylinder;

an outer discharge cover spaced from an outer surface of the inner discharge cover; and a loop pipe which discharges fluid within the outer discharge cover to an exterior of the compressor, said loop pipe extending into the outer discharge cover, and an end of the loop pipe extending into the outer cover configured such that, when at least a portion of an edge of the end of the loop pipe is in contact with an outer surface of the inner discharge cover at which the opening is not positioned, another portion of the edge of the end of the loop pipe is spaced from the outer surface of the inner discharge cover.

12. A linear compressor comprising;

a hermetic casing;

a linear motor provided in the hermetic easing;

a cylinder block in the linear motor and provided with a cylinder;

a piston which is linearly reciprocated in the cylinder by the linear motor; and a discharge clement positioned in the front of an opening of the cylinder to discharge fluid compressed in the cylinder, wherein the discharge element includes:

a discharge valve which opens and closes the cylinder;

an inner discharge cover which elastically supports the discharge valve and has an opening to discharge fluid drained from the cylinder;

an outer discharge cover spaced from an outer surface of the inner discharge cover; and a loop pipe which discharges fluid within the outer discharge cover to an exterior of the compressor, said loop pipe extending into the outer discharge cover, and an end of the loop pipe extending into the outer cover configured such that, when at least a portion of an edge of the end of the loop pipe is in contact with the inner discharge cover, another portion of the edge of the end of the loop pipe is spaced from the inner discharge cover, and wherein the end of the loop pipe that extends into the outer discharge cover is slanted with respect to the outer surface of the inner discharge cover.

13. The linear compressor as set forth in claim 12, wherein a connection pipe is provided in the outer discharge cover, so as to be connected to the loop pipe.

14. The linear compressor as set forth in claim 13, wherein an outlet is provided in the outer discharge cover and extends perpendicularly to a direction of movement of the piston in the cylinder.

15. The linear compressor as set forth in claim 14, wherein the connection pipe is provided in the outlet.

16. The linear compressor as set forth in claim 13, wherein a connection between the loop pipe and the connection pipe comprises a weld.

17. The linear compressor as set forth in claim 16, wherein the loop pipe is configured to define at least one loop within the hermetic casing.

18. The linear compressor as set forth in claim 17, wherein the inner discharge cover has a discharge spring to elastically support the discharge valve.

19. The linear compressor as set forth in claim 18, wherein the discharge spring is a conic coil spring configured to apply an elastic biasing force in a direction such that the discharge valve closes the opening of the cylinder.

20. The linear compressor as set forth in claim 16, wherein the loop pipe comprises a vibration reducing and noise preventing material within the hermetic casing.

* * * * *